US009266710B2

(12) United States Patent
Fedde et al.

(10) Patent No.: US 9,266,710 B2
(45) Date of Patent: Feb. 23, 2016

(54) FUEL NOZZLE

(71) Applicants: Matthias Fedde, Hamburg (DE); Achim Aehle, Bordesholm (DE); Stefan Kunter, Hamburg (DE)

(72) Inventors: Matthias Fedde, Hamburg (DE); Achim Aehle, Bordesholm (DE); Stefan Kunter, Hamburg (DE)

(73) Assignee: ELAFLEX HIBY TANKTECHNIK GMBH & CO. KG, Hamburg (DE)

( * ) Notice: Subject to any disclaimer, the term of this patent is extended or adjusted under 35 U.S.C. 154(b) by 489 days.

(21) Appl. No.: 13/630,737

(22) Filed: Sep. 28, 2012

(65) Prior Publication Data

US 2013/0081738 A1 Apr. 4, 2013

(30) Foreign Application Priority Data

Sep. 30, 2011 (EP) ..... 11183398

(51) Int. Cl.

| | |
|---|---|
| ***B67D 7/42*** | (2010.01) |
| ***B67D 7/32*** | (2010.01) |
| ***B67D 7/54*** | (2010.01) |
| ***B67D 7/56*** | (2010.01) |

(52) U.S. Cl.

CPC ..... *B67D 7/3236* (2013.01); *B67D 7/42* (2013.01); *B67D 7/54* (2013.01); *B67D 7/56* (2013.01)

(58) Field of Classification Search

CPC ..... B67D 7/3263; B67D 7/42; B67D 7/54; B67D 7/56

USPC ..... 141/85–87, 94, 98, 285, 301, 363, 392

See application file for complete search history.

(56) References Cited

U.S. PATENT DOCUMENTS

| | | | | |
|---|---|---|---|---|
| 1,929,719 | A * | 10/1933 | Werder | 141/349 |
| 2,826,455 | A * | 3/1958 | Furton | 141/392 |
| 3,255,771 | A * | 6/1966 | MacSpadden | 137/355.12 |
| 3,759,423 | A * | 9/1973 | Hansel | 141/392 |
| 3,815,784 | A * | 6/1974 | Hansel | 141/351 |
| 5,159,523 | A | 10/1992 | Claassen et al. | |
| 6,924,740 | B2 * | 8/2005 | Edge | 340/549 |
| 7,078,621 | B1 * | 7/2006 | Carpenter et al. | 174/51 |
| 8,476,913 | B2 * | 7/2013 | Dunn et al. | 324/707 |
| 2011/0186176 | A1 * | 8/2011 | Aehle et al. | 141/350 |
| 2013/0087247 | A1 * | 4/2013 | Aehle et al. | 141/346 |

FOREIGN PATENT DOCUMENTS

| | | |
|---|---|---|
| GB | 1562494 | 3/1980 |
| WO | 03/045831 A1 | 6/2003 |

OTHER PUBLICATIONS

US Army Technical Manual, TM 5-4930-235-13&P, Aug. 16, 1988, Figure 2-2.1.*

* cited by examiner

*Primary Examiner* — Nicolas A Arnett
(74) *Attorney, Agent, or Firm* — Casimir Jones, S.C.; Mary Ann D. Brow

(57) ABSTRACT

The invention provides a dispensing valve or fuel nozzle having an earth (ground) cable and/or a safety cap for covering the discharge opening, the safety cap connected by a cord to the dispensing valve, wherein the dispensing valve has an automatic retraction system for the earth cable and/or the cord of said safety cap.

19 Claims, 7 Drawing Sheets

FUEL NOZZLE

CROSS-REFERENCE TO RELATED APPLICATIONS

This application claims the benefit of European Application No. 11183398.4, filed Sep. 30, 2011, which is incorporated herein by reference in its entirety.

BACKGROUND OF THE INVENTION

The invention relates to a dispensing valve or nozzle for filling liquids into a storage container. The refueling of, in particular, smaller aircraft is effected using so-called airfield refueling valves, by means of which fuel is discharged into fill openings that are frequently located on the topside of the wings (overwing refueling). The carrying out of such overwing refueling is expensive and time-consuming, and requires considerable skill because, on the one hand, the dispensing valve together with a heavy fill hose has to be moved into the necessary overwing position and, on the other hand, a safety or protective cap has to be removed from the discharge pipe of the dispensing valve (nozzle) prior to the refueling operation. Further, an earth cable (ground wire) on the dispensing valve must be connected to the aircraft in order to produce a connection to frame.

BRIEF SUMMARY OF THE INVENTION

The object underlying the invention is to create a dispensing valve of the aforementioned type, which makes a refueling operation simpler for the user and consequently is suitable for use as an airfield refueling valve.

The object is achieved in that the earth cable has an automatic retraction system. In this case, in particular, this can be a take-up or rewinding roller that is biased into the take-up or rewound position. In this way, once the refueling operation has been completed, the earth cable can be taken-up automatically and does not interfere with the further handling of the dispensing valve. According to the invention, the safety cap can be connected to the dispensing valve by means of a cord, and an automatic retraction system can also be provided for said cord.

BRIEF DESCRIPTION OF THE DRAWINGS

Exemplary embodiments of the invention are described below by way of the drawings, in which.

DETAILED DESCRIPTION OF THE INVENTION

Figure 1:
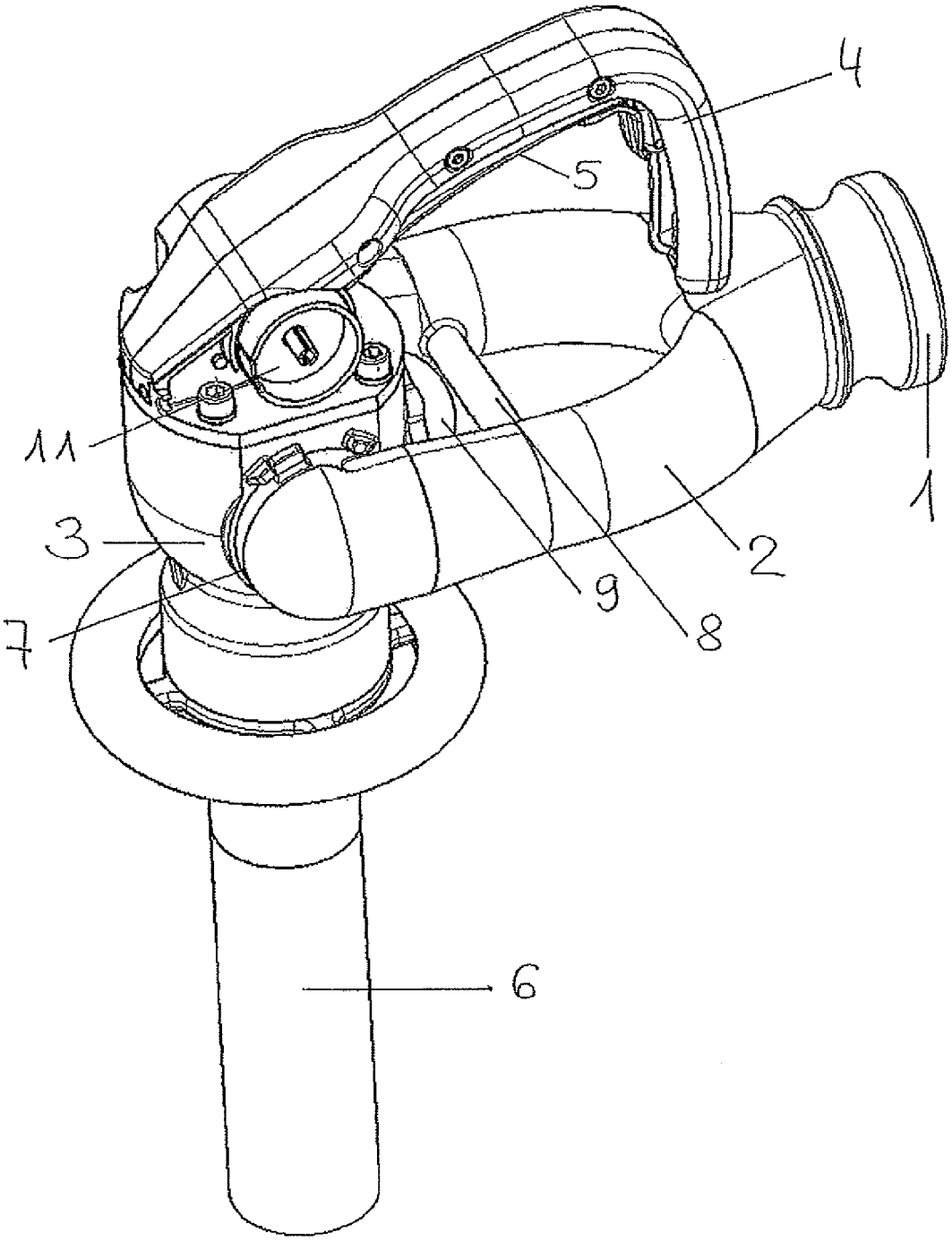
FIG. 1 shows a view of a dispensing valve according to the invention.

First, some of the terms used in the context of the invention are explained. The dispensing valve according to the invention is designed for filling liquids, in particular fuels or other operating liquids, into a storage container. The storage container can be, in particular, a fuel tank, for example the fuel tank of an aircraft or of another vehicle. A main valve meters the liquid output. An actuating lever (also called a control lever) serves for actuating the main valve. The main valve is prestressed or biased into the closed position, in which it stops the liquid discharge. The bias into the closed position generally occurs by means of spring force.

Airfield refueling valves, as a rule, have to have an earth cable (ground wire), by means of which a connection to the frame of the aircraft is made prior to the start of the refueling operation. As a rule, a protective covering cap (safety cap) is also provided to protect the discharge end when it is not in use. The invention has recognized that a loose cable end hanging down, or a loose safety cap hanging down on the end of a cord can make the handling of the dispensing valve considerably more difficult. The user of the dispensing valve not only has to handle the valve together with the heavy supply hose and move them into position, he also has to take care that the ends of the cable or of the cord that are hanging down are not in the way or, for example, do not get caught on projections or other obstacles when the dispensing valve is being transported.

The advantage of the automatic retraction system provided according to the invention is that, for example, in the case of overwing refueling, there are no ends of a cable or cord hanging loosely from the dispensing valve, such as can interfere with the handling or can possibly lead to damage of the wing surface or the paint thereon when the dispensing valve is inserted or removed.

In one advantageous embodiment of the invention, it is provided that the valve actuation has a progressive characteristic line, where, at the start of the valve opening lift, when the actuating lever is first impinged upon with an actuating force, a greater opening force is exerted onto the main valve than is exerted during the later course of the valve opening lift, when the actuating lever is impinged upon with identical actuating force over the continuing course of the valve opening lift.

According to said development of the invention, it is provided that the valve actuation mechanism has a progressive characteristic line. At the start of the valve opening lift or stroke (and consequently at the start of the actuation path of the actuating lever), the impinging of the actuation lever with a defined actuating force brings about a greater opening force onto the main valve than when the identical actuating force is exerted during the continued course of the valve opening lift (and consequently of the actuating path of the actuation lever). This correlates to a modified path reduction. For a defined valve lift at the start of the valve opening operation, a longer actuating path of the actuating lever is necessary than for the identical valve lift in the continued course of or toward the end of the valve lift operation.

Said embodiment of the invention resolves the apparent conflict of, in the case of a dispensing valve, on the one hand avoiding high actuating forces for the actuating lever, while at the same time making a small lever path possible. The lifting force necessary for opening the main valve is at its maximum at the moment of the start of the opening operation, as at this moment there is still no volumetric flow through the valve and the full pressure difference between the inflow side and the discharge side of the valve acts on the valve disk and, in addition to the spring force, presses said valve disk into the closed position. The stronger reduction of the lever path in the valve lift path provided according to the invention reduces the actuating force at the actuating lever necessary to overcome said initial resistance. The pressure difference over the valve is reduced after the start of the valve opening on account of the liquid flow and the lift forces necessary for opening the main valve further are reduced. The invention utilizes this by now providing a smaller reduction of lever path to valve lift path. The actuating force at the actuating lever can remain approximately the same, the now changed reduction ratio reduces the lever path until the complete opening position of the main valve is reached. Consequently, a comparatively small lever path is necessary for the complete valve opening, nevertheless at the start of the opening operation on account of the then stronger reduction, only a comparatively small actuating force is necessary. This makes the handling of the valve easier, in particular when it is used as an airfield refueling valve in overwing mode.

The actuating lever and the valve actuation mechanism of the main valve (consequently in a preferred manner the valve rod) are preferably connected kinematically by means of a coupler mechanism with a transformation that is variable during the course of the actuating path of the actuating lever. Said transformation can be modified to the effect that, at the start of the opening lift of the valve, a stronger reduction of the lever path in the valve path is effected than in the continued development of or toward the end of the opening lift.

Different developments or designs of said coupler mechanism are conceivable. In the case of a first preferred embodiment of the invention, the coupler mechanism has an entrainment lever which is coupled to the actuating lever, the first actuating end of which is operatively connected to the valve rod of the main valve. In a preferred manner, the entrainment lever has a second end which is coupled to the first end of a reversing lever, the second end of which, in its turn, is coupled to a stationary region of the dispensing valve. In the course of the actuation of the actuating lever, the angular position of the entrainment lever is altered in a manner explained in more detail in the exemplary embodiments and thus causes the actuating end of the entrainment lever to be pivoted in the opening direction of the valve rod. Said pivoting movement of the entrainment lever through a rotation or pivoting about the coupling axis at the actuating lever causes the actuating end of the entrainment lever to be moved additionally in the operating direction of the main valve and thus enlarges the actuation path of the valve and consequently the effectively utilized valve lift.

It can be provided according to the invention that the first actuating end of the entrainment lever has a substantially straight-line motion. When actuated, the actuating lever usually pivots about an axis and consequently carries out a circle segment movement. The entrainment lever can pivot in the opposite direction about its coupling axis on the actuating lever. The radii of the two contra-directional circular arcs can be realized in such a manner that, as a result, the actuating end of the entrainment lever has a substantially straight-line movement in the direction of the opening lift of the valve. This makes it possible to open the main valve in a particularly efficient, low-friction and low-wearing manner as there are no friction forces, or at the outside few friction forces, at the operative connection between the actuating end of the entrainment lever and the valve rod.

In the case of another embodiment of the invention, the coupler mechanism can have a drag lever. Said drag lever preferably has a coupling point and an actuating end which, in a preferred manner, is arranged at a spacing from the coupling point. In a preferred manner, the drag lever is raised by an actuating element of the actuating lever, during the course of the actuating of the actuating lever said actuating element being displaced along the drag lever toward the direction of the coupling point thereof and thus, due to the changed lever ratios, a certain path of the actuating lever during the continued development of the opening operation brings about a correspondingly greater path of the actuating end of the drag lever.

In the case of an advantageous embodiment of the invention, the valve body has two inlets which are arranged diametrically opposite each other and to which two inlet regions of the dispensing valve housing are connected. The liquid inlet then does not take place from the end face of the valve body or valve housing located opposite the discharge opening or the discharge pipe, but rather the liquid is supplied from the side, in a preferred manner the direction of supply lies approximately at right angles with respect to the direction of lift of the valve rod. The actuating mechanism including the actuating lever can be arranged in the region of the end face of the valve body located opposite the discharge opening. Said structural development provides a series of advantages. On the one hand, the described "bending away" of the direction of supply in relation to the discharging direction facilitates the handling of the dispensing valve, for example in a typical overwing refueling situation. On the other hand, the relatively free arrangement of the actuating mechanism at the free end face of the valve body makes handling and actuating possible from various directions without any impairment caused by the supply hose. The handling and for example the overwing refueling is improved even further by inlet regions which are connected to the inlets of the valve body so as to be pivotable. In this case, this is a liquid connection which is realized as a pivot joint. Said ability to pivot once again facilitates handling as the angle between the usually extremely heavy and frequently not very flexible supply hose and the discharge pipe can be set in a better manner and thus refueling is made easier. The ability to pivot can be limited by stop members and can include purely a small angular region of, for example, between 10 and 15°. As an alternative to this, a complete change, for example about 180° can be made possible if this is not impeded by the actuating mechanism at the end face of the valve body.

In a preferred manner, the inlet regions of the dispensing valve housing can extend in the manner of a fork from the hose connection of the dispensing valve toward the described inlets of the valve body. The flow of liquid through the supply hose is divided in this manner into two part flows and is supplied to the valve body by means of the two diametrically opposite inlets. This facilitates higher volume flows through the dispensing valve. Such a development with large cross sectional flows also reduces the occurring of pressure losses.

It can be provided according to the invention that a connecting web, which is preferably realized as a liquid passage, is provided between the fork-shaped inlet regions. Said connecting web increases the stability and strength of the structure and, according to the invention, can also have an inspection glass which makes a visual check on the refueling operation possible. The inspection glass is then arranged in a protected manner in the inside region of the fork between the two inlet regions. As an alternative to this, the inspection glass can be arranged in the valve body, in a preferred manner in the region which is protected by the fork-shaped inlet regions.

In a preferred manner, the dispensing valve has a nominal width of at least 25 mm, in a more preferable manner a nominal width range of between 40 mm and 50 mm. The named values can be combined in an arbitrary manner to form regions according to the invention. In a preferred manner, it is provided for a delivery performance of at least 150 l/min, in a more preferable manner at least 200, 300 or 400 l/min. A preferred maximum value of the delivery performance is 800 l/min. The named values can be combined to form regions according to the invention.

It can also be provided that the dispensing valve according to the invention has a quick change pipe (discharge pipe).

Figure 3:
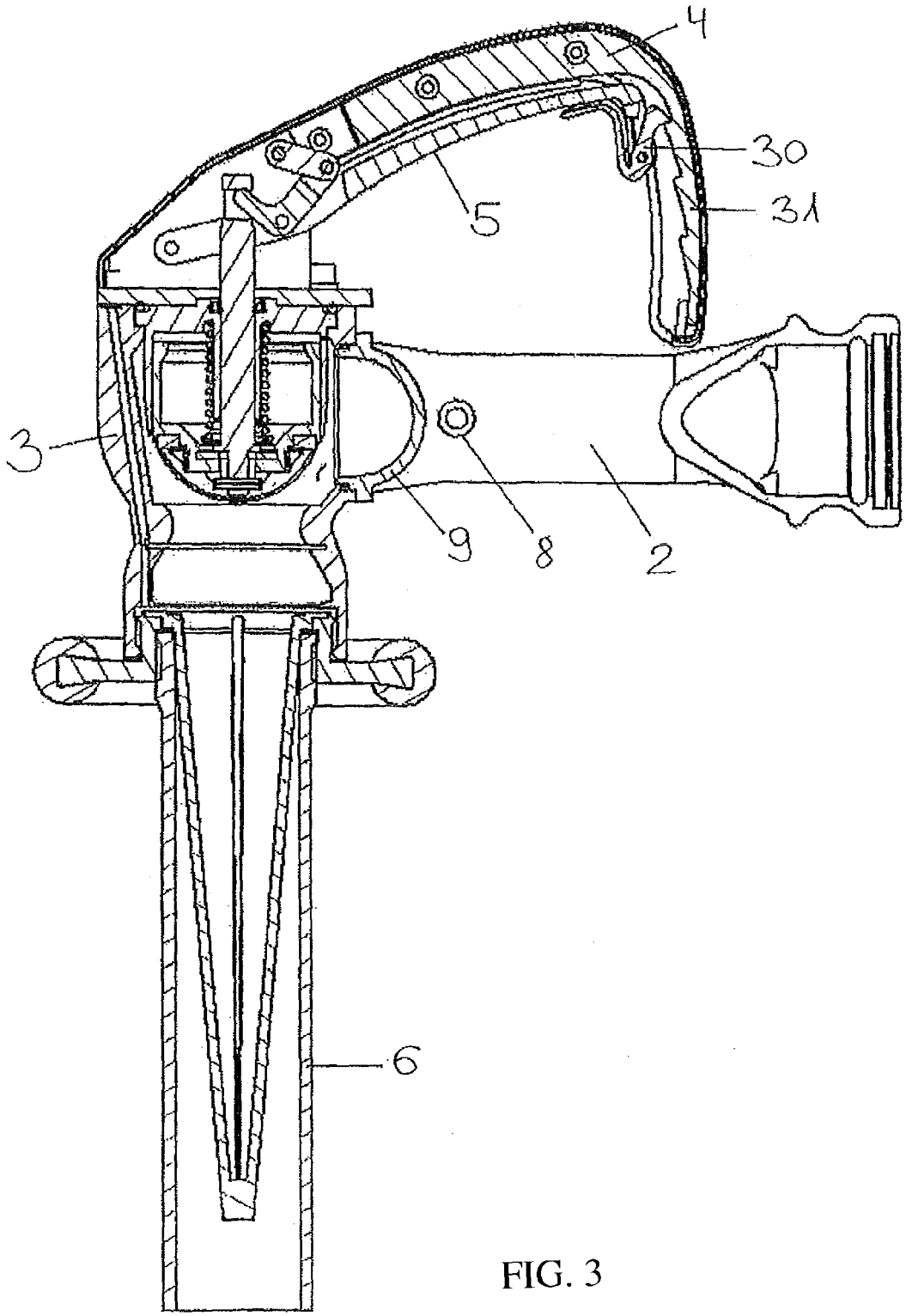
FIG. 3 shows a sectioned drawing of a dispensing valve according to the invention.

The dispensing valve according to the invention shown in FIG. 1 basically has a hose connection 1, inlet regions 2 which are splayed apart in the manner of a fork, a valve body 3, an actuating mechanism with a handle 4 and an actuating lever 5 as well as a discharge pipe 6. The discharge pipe 6, as can be seen in FIG. 3, is realized as a quick change pipe. The valve body 3 has two liquid passages which are diametrically opposite each other and are realized as pivot joints, at which liquid flows out of the inlet regions 2 into the valve body 3. The inlet regions 2 are realized so as to be pivotable about said rotary joints 7 in relation to the valve body 3.

The handle 4 and the actuating lever 5 are arranged on the end side of the valve body 3 opposite the discharge end. It can be seen that, through the development shown, said actuating elements are able to be gripped freely from all sides as they are arranged above the hose connection 1.

A connecting web 8 (realized as a liquid-permeable connecting pipe) is arranged between the inlet regions 2 in the vicinity of the valve body 3 in order to increase the stability of the dispensing valve. An inspection glass, indicated by the reference 9, is arranged in a protected manner in the region of the valve body 3 enclosed by the inlet regions 2, it being possible to monitor the refueling operation through said inspection glass.

Figure 2:
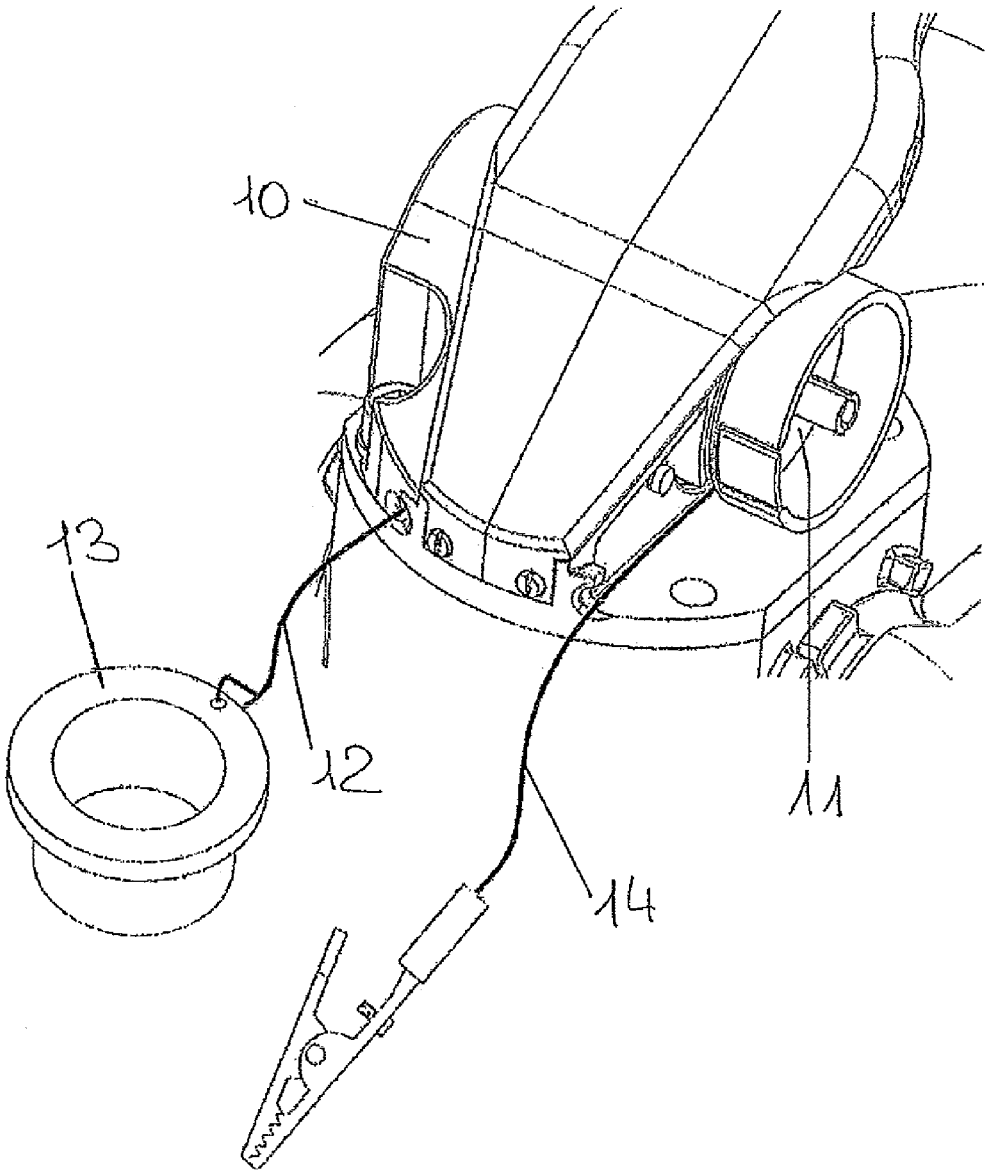
FIG. 2 shows a view of the automatic retraction system for the earth cable and the cord of the safety cap.

FIG. 2 shows details of the automatic retraction system according to the invention. Two take-up reels 10, 11, which are prestressed into the take-up position by means of springs (not shown), are arranged at the end-face side of the valve body 3 in the region of the base of the handle 4. A cord 12 with a safety cap 13 for the outlet pipe 6 fastened thereto can be removed from the reels 10, 11. In the idle state of the dispensing valve, the safety cap 13 can protect the discharge end of the discharge pipe 6. If the safety cap 13 is removed in preparation for the refueling operation, the cord 12 is taken-up on the reel 10 and the safety cap 13 is pulled toward the dispensing valve. It does not hang down and does not interfere with the handling during the refueling operation. An earth cable 14, to which an earth terminal is connected, is taken-up on the reel 11. The earth cable 14 is taken-up again in the idle state and the earth terminal does not hang down loosely. Prior to the start of the refueling operation, a necessary length of the earth cable 14 is pulled out and a connection to frame between the dispensing valve and for example the aircraft is produced.

Inside the valve body 3, the main valve of the dispensing valve according to the invention has a valve disk which, in the closed state, abuts sealingly against a valve seat 16 by way of a valve seal 15. In said closed position, the valve is held by means of a valve spring 17. The valve can be moved into an open position in opposition to the force of the spring 17 by means of a valve rod 18. In the end pointing away from the valve seat 16, the valve rod 18 has a bore 19 which extends transversely with respect to its axis, through which bore the actuating end 20 of an entrainment lever 22, which is connected to the actuating lever 5 so as to be pivotable at 21, engages. The entrainment lever 22 is connected to a reversing lever 24 at 23 so as to be pivotable, the second end of said reversing lever, in its turn, being coupled at 25 to a fixed part of the valve body or of the handle so as to be pivotable.

The coupler mechanism with variable reduction, which has been depicted beforehand and which brings about the progressive characteristic line according to the invention, is created by the interaction between the actuating lever 5 (with its pivot axis 26), reversing lever 24, entrainment lever 22 and valve rod 18.

Figure 4:
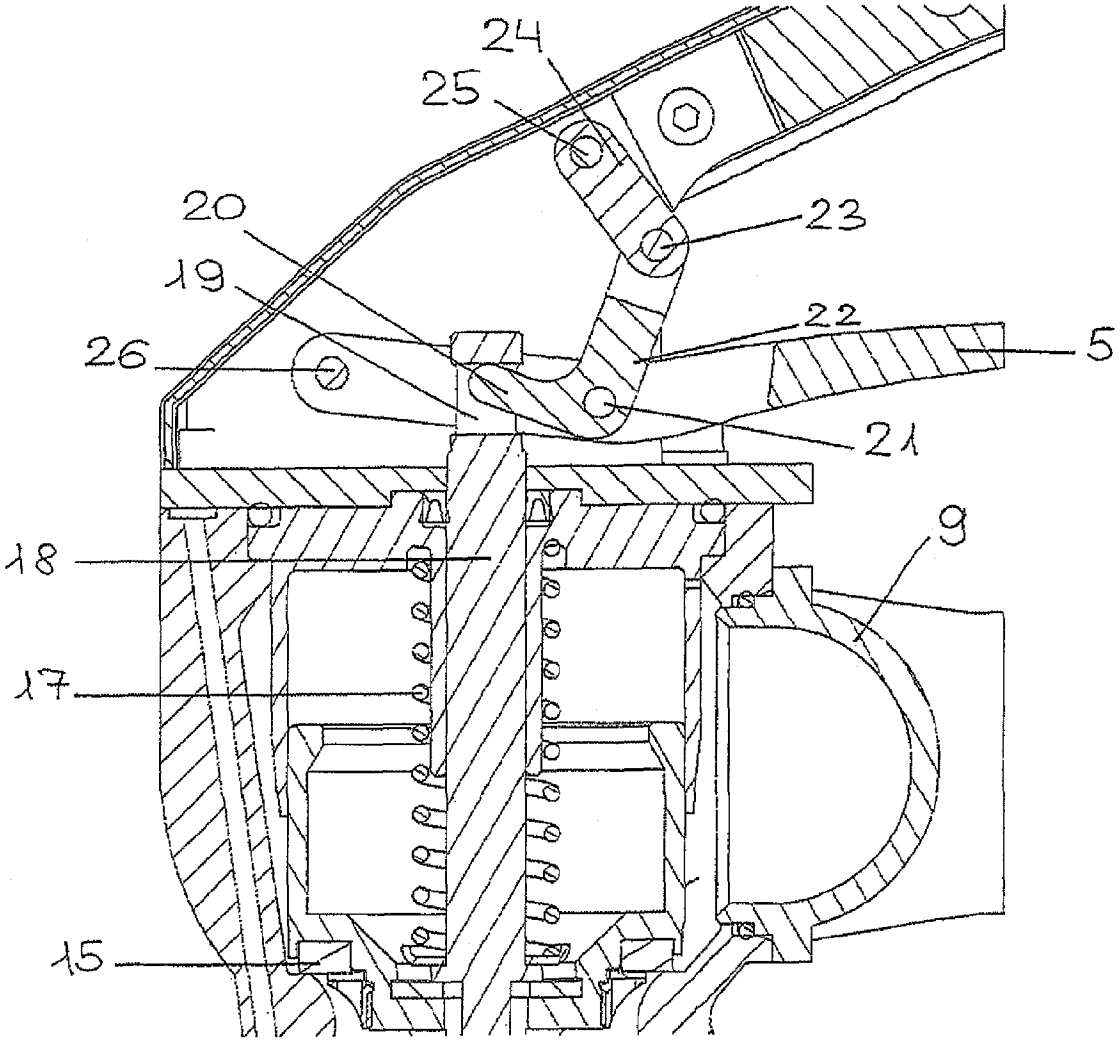
FIG. 4 shows the dispensing valve in the closed state in a detail from FIG. 1.
Figure 5:
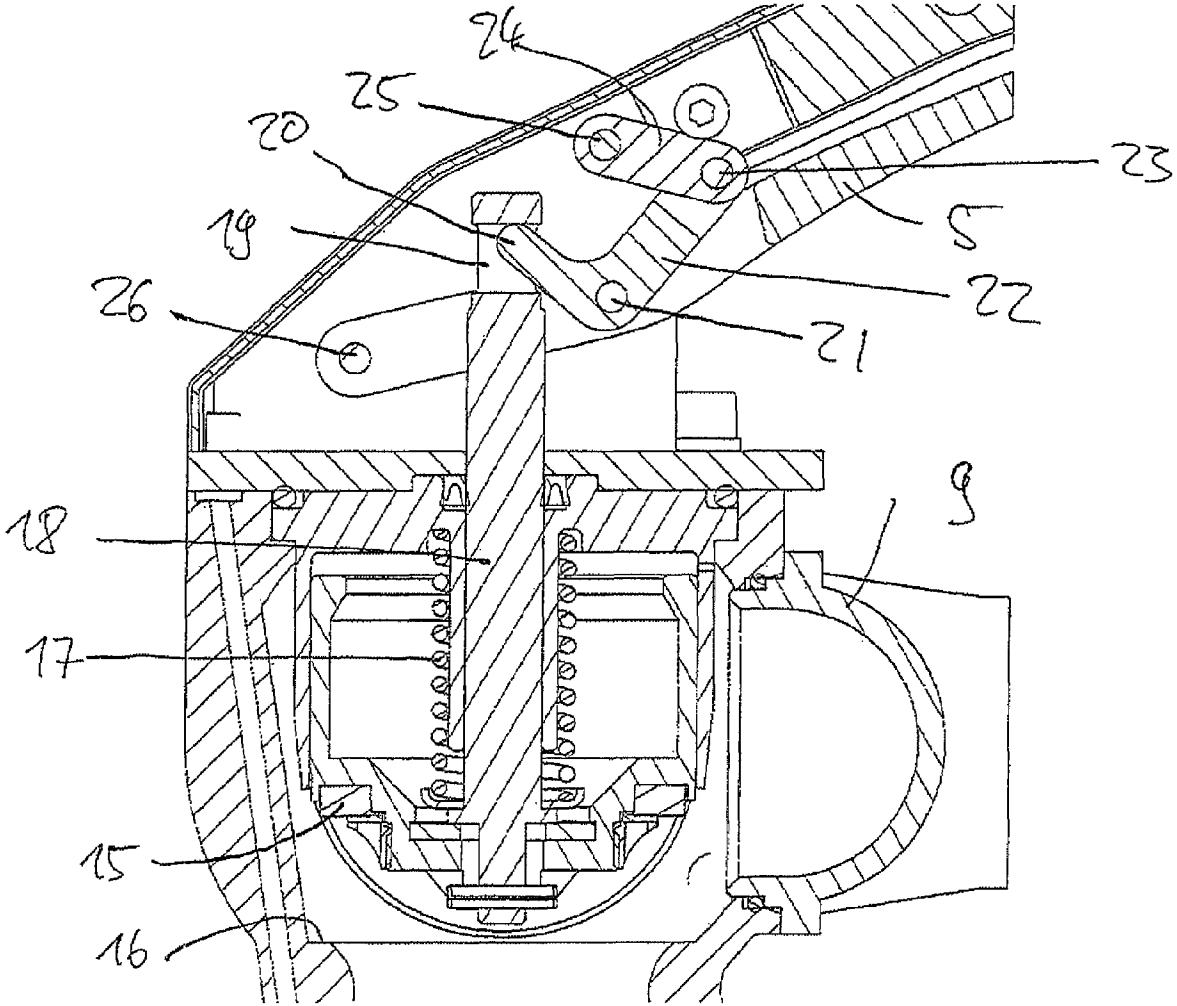
FIG. 5 shows the dispensing valve in the open state in a detail from FIG. 3.

FIG. 4 shows the dispensing valve in the closed state. The valve seal 15 abuts against the valve seat 16 in a liquid-tight manner. If the actuating lever 5 is moved upward out of the idle position shown in FIG. 4, the pivot axis 21 of the entrainment lever 22 describes a circular arc, the radius of which corresponds to the spacing between the axis 26 of the actuating lever 5 and the named pivot axis 21. At the same time, through the movement of the actuating lever 5, the spacing between the axis 21 of the entrainment lever 22 and the axis 25 of the reversing lever 24 is reduced such that they experience a rotary movement about the axis 23 in relation to each other. In this case, the entrainment lever 22 experiences a rotary movement about the axis 21 in relation to the actuating lever 5. The combination of the pivoting movements of the entrainment lever 22 about the axis 26 of the actuating lever 5, on the one hand, and the contra-directional pivoting movement about the axis 21, on the other hand, causes the actuating end 20 of the entrainment lever 22 to experience a substantially straight-line movement upward and, as a result of the operative connection in the bore 19, to lift up the valve rod 18 in opposition to the force of the spring 17 and to open the valve. It can be seen in FIGS. 4 and 5 that the kinematics of the coupler mechanism are such that, with the actuating lever 5 being progressively moved by means of the depicted contra-directional pivoting movements of the entrainment lever 22, the reduction of the coupler mechanism is steadily reduced such that, at the start of the movement of the actuating lever 5, a specific pivot angle about the axis 26 brings about a smaller opening lift of the valve than the identical pivot angle about the axis 26 during the continued course of the opening. The force reduction is correspondingly contra-directional.

Figure 6:
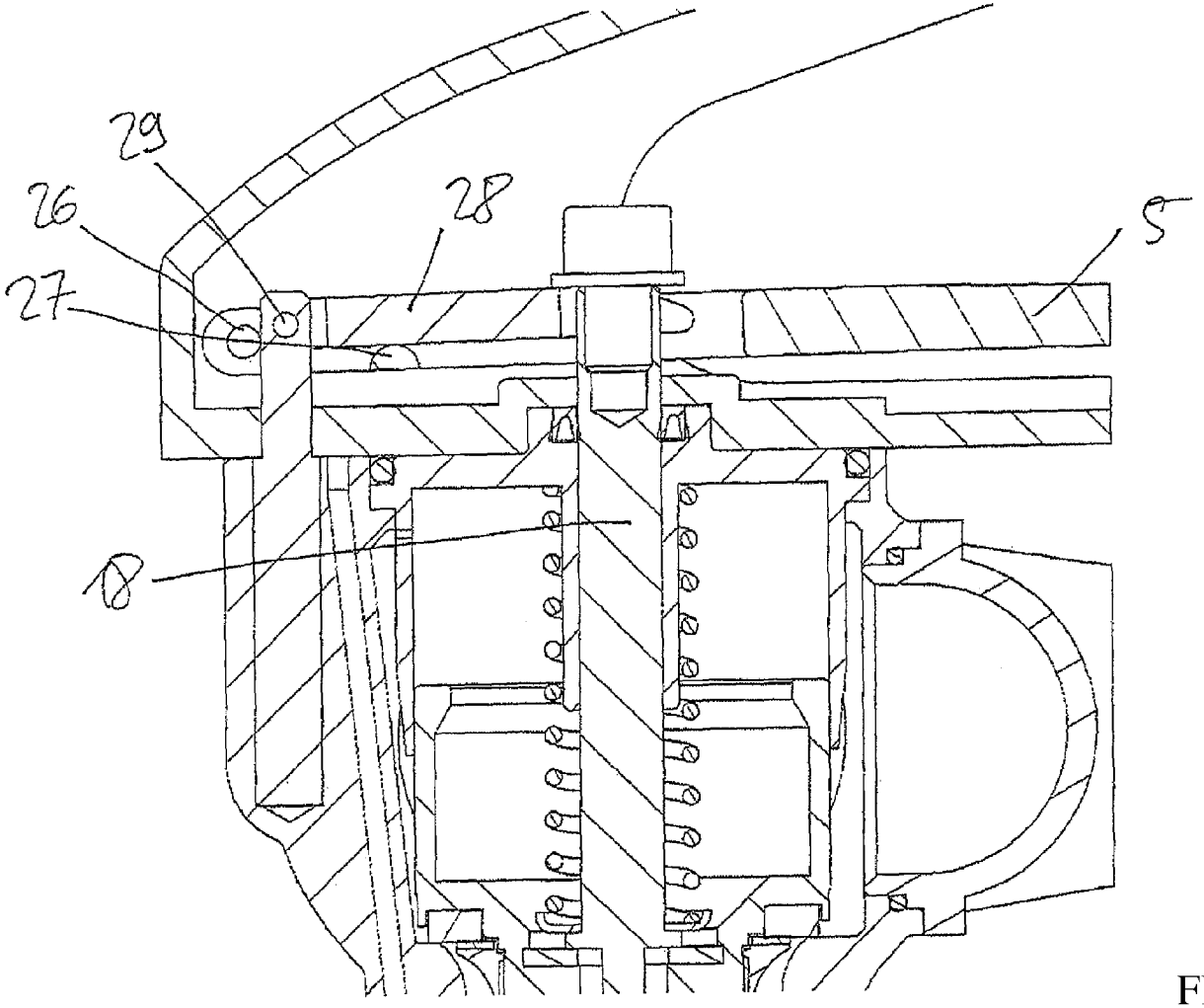
FIG. 6 shows a detail from another embodiment with a drag lever in the closed state.
Figure 7:
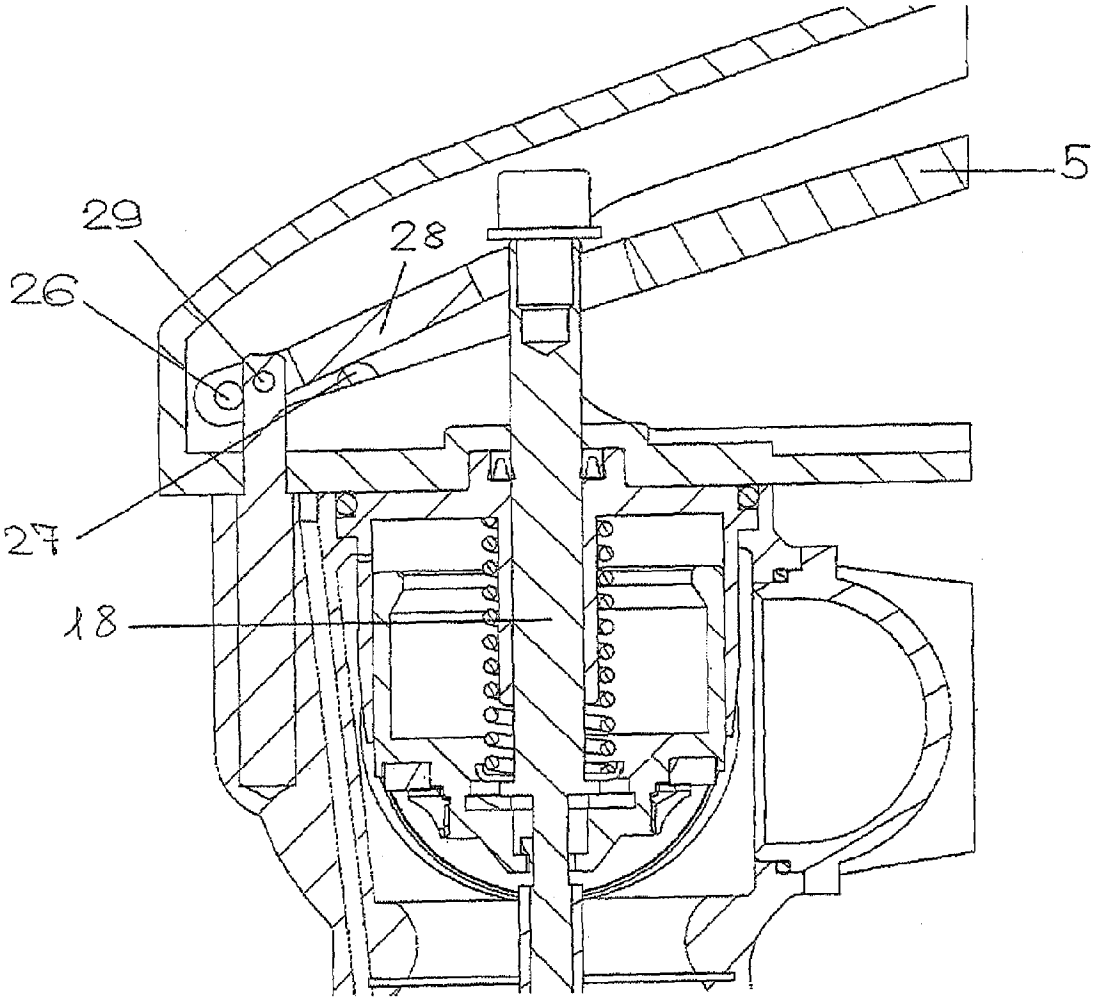
FIG. 7 shows the embodiment of FIG. 6 in the open state.

FIGS. 6 and 7 show a second embodiment of the invention, where the coupler mechanism has a drag lever. In this case, the actuating lever 5 is connected operatively by means of a projection 27 to a drag lever 28 which is coupled so as to be pivotable at 29. By way of its end remote from the pivot axis 29, the drag lever 28 is in operative connection with a bore in the valve rod 18 and can lift said valve rod.

As can be seen by comparing FIGS. 6 and 7, when the actuating lever 5 is moved, the projection 27 thereof lifts up the drag lever 28 and thus opens the valve. During the course of said movement, the projection 27 slides along the underside of the drag lever 28 and, as a result of the relative arrangement of the pivot axis 26 of the actuating lever 5, on the one hand, and of the pivot axis 29 of the drag lever 28, on the other hand, the spacing between the pivot axis 29 and the point of action of the projection 27 on the drag lever 28 is reduced. Through said reduction in the spacing, the lever length is changed in such a manner that, at the start of the actuating operation, a defined change in the angle of the drag lever 5 brings about a smaller opening lift of the valve than a pivoting movement of the actuating lever 5 about the identical angle in the continued course of the opening movement. Consequently, a coupler mechanism with changeable reduction is obtained once again.

It can also be seen in FIG. 3 that the actuating lever 5 has a holding-open aid 30 which makes it possible for the actuating lever 5 to be held open using reduced manual force in three opening positions which are defined by notches 31 on the handle 4, as is described in EP 2 186 773 A1. The object of said application is also made the object of the present disclosure by means of reference thereto.

The invention claimed is:

1. A dispensing valve for filling liquids into a storage container, said dispensing valve having an earth cable (14), wherein said dispensing valve has an automatic retraction system for said earth cable, wherein said dispensing valve comprises:

i) a main valve, and ii) an actuating lever (5) designed for opening said main valve in opposition to a force biasing the main valve into a closed position, wherein the actuating lever (5) and a valve actuation mechanism of the main valve are connected kinematically by means of a coupler mechanism with a transformation that is variable during the course of the actuating path of the actuating lever (5).

2. The dispensing valve of claim 1, wherein the coupler mechanism has an entrainment lever (22) that is coupled to the actuating lever (5), wherein a first actuating end (20) of said entrainment lever (22) is operatively connected to valve rod (18) of the main valve.

3. The dispensing valve of claim 2, wherein said entrainment lever (22) has a second end that is coupled to a first end of a reversing lever (24), wherein a second end of said reversing lever (24) is coupled to a stationary region of the dispensing valve.

4. The dispensing valve of claim 3, wherein the first actuating end (20) of the entrainment lever (22) has a substantially straight-line motion.

5. The dispensing valve of claim 1, wherein the coupler mechanism has a drag lever (28).

6. The dispensing valve of claim 1, wherein a valve body (3) has two inlets (2) that are arranged diametrically opposite, and to which two inlet regions (7) of a dispensing valve housing are connected.

7. The dispensing valve of claim 6, wherein the inlet regions (7) of the dispensing valve housing are connected to the inlets (2) of the valve body (3) so as to be pivotable.

8. The dispensing valve of claim 6, wherein the inlet regions (2) of the dispensing valve housing extend in a fork-shape from hose connection (1) of the dispensing valve toward the inlets (7) of the valve body (3).

9. The dispensing valve of claim 8, wherein a connecting web (8) is provided between the fork-shaped inlet regions.

10. The dispensing valve of claim 9, wherein said connecting web (8) is a liquid passage.

11. The dispensing valve of claim 9, wherein an inspection glass (9) is provided in the valve body (3) or in the connecting web (8).

12. The dispensing valve of claim 1, wherein said dispensing valve has a nominal width of at least 25 mm.

13. The dispensing valve of claim 1, wherein said dispensing valve has a nominal width of 40 mm to 50 mm.

14. The dispensing valve of claim 1, wherein said dispensing valve has a delivery performance of at least 150 l/min.

15. The dispensing valve of claim 1, wherein said dispensing valve has a delivery performance of at least 200 l/min.

16. The dispensing valve of claim 1, wherein said dispensing valve has a delivery performance of at least 300 l/min.

17. The dispensing valve of claim 1, wherein said dispensing valve has a delivery performance of at least 400 l/min.

18. The dispensing valve of claim 1, wherein said dispensing valve has a delivery performance of a maximum of 800 l/min.

19. The dispensing valve of claim 1, wherein said dispensing valve has a quick change pipe (6).

* * * * *